US008746520B1

(12) United States Patent
Buth

(10) Patent No.: US 8,746,520 B1
(45) Date of Patent: Jun. 10, 2014

(54) BINDING PACK FOR SNOWBOARD

(76) Inventor: Michael J. Buth, Grand Rapids, MI (US)

( * ) Notice: Subject to any disclaimer, the term of this patent is extended or adjusted under 35 U.S.C. 154(b) by 411 days.

(21) Appl. No.: 13/152,707

(22) Filed: Jun. 3, 2011

Related U.S. Application Data

(60) Provisional application No. 61/352,898, filed on Jun. 9, 2010.

(51) Int. Cl.
*B60R 7/00* (2006.01)

(52) U.S. Cl.
USPC ..... 224/401; 224/572; 224/585; 280/816

(58) Field of Classification Search
USPC ..... 224/401, 578, 148.6, 254, 255, 269, 224/673, 674, 675, 650, 651, 600, 904, 572, 224/682, 684, 223; 280/809, 816; 24/301, 24/302, 3.7, 3.9
See application file for complete search history.

(56) References Cited

U.S. PATENT DOCUMENTS

| | | | | |
|---|---|---|---|---|
| 2,264,481 | A * | 12/1941 | Peterson | 294/148 |
| 5,096,103 | A | 3/1992 | Baugh | |
| 5,259,093 | A * | 11/1993 | D'Annunzio | 24/3.9 |
| 6,352,459 | B1 | 3/2002 | Hodge et al. | |
| 6,457,746 | B1 | 10/2002 | Schepers | |
| 7,422,131 | B2 * | 9/2008 | Cohen | 224/654 |
| 8,256,652 | B2 * | 9/2012 | Murdoch et al. | 224/672 |
| 8,474,673 | B2 * | 7/2013 | Murdoch et al. | 224/672 |
| 2002/0038811 | A1 * | 4/2002 | Vigny | 224/651 |
| 2009/0117300 | A1 * | 5/2009 | Thompson | 428/35.2 |

OTHER PUBLICATIONS

Bakoda Hi-Back Pack website printout (http://www.bargainboards.co.uk/P/Bakoda-Hi-Back-ADVANCED-Pack(6445).aspx), believed to be on sale or publicly disclosed more than one year prior to Jun. 9, 2010.

* cited by examiner

*Primary Examiner* — Justin Larson
*Assistant Examiner* — Phillip Schmidt
(74) *Attorney, Agent, or Firm* — Gardner, Linn, Burkhart & Flory, LLP

(57) ABSTRACT

A carrying case that is adjustably mountable to a binding of a snowboard includes a bag and a mounting strap configured for attaching at the bag. A plurality of generally vertical slots, at least one first angled slot and at least one second angled slot are established either through the mounting strap or between the mounting strap and the bag. The generally vertical slots are configured to receive a toe strap of a snowboard binding therethrough while one of the first and second angled slots are configured to receive an ankle strap of the snowboard binding therethrough. When the carrying case is disposed at a snowboard, the toe strap of the binding passes through one of the generally vertical slots, while the ankle strap of the binding passes through an appropriate one of the first and second angled slots to secure the carrying case to the binding and snowboard.

13 Claims, 4 Drawing Sheets

BINDING PACK FOR SNOWBOARD

CROSS REFERENCE TO RELATED APPLICATION

The present application claims the filing benefit of U.S. provisional application Ser. No. 61/352,898, filed Jun. 9, 2010, which is hereby incorporated herein by reference in its entirety.

FIELD OF THE INVENTION

The present invention relates to the attachment of a carrying case or storage bag directly to a conventional "strap-in" snowboard binding and, more particularly to a carrying case or storage bag that attaches to the straps of a conventional strap-in snowboard binding.

BACKGROUND OF THE INVENTION

Two types of prior art snowboard bags are known to the inventor. The first is a small storage bag that is attached directly to the snowboard using superglue or other adhesive. The bag is quite small, only intended to carry a wallet and keys and maybe a candy bar.

Another known small storage bag is slightly larger than the first one, but still relies on adhesive VELCRO® as a means of attaching their bag directly to the surface of the snowboard. The bag may include a "shoulder strap" as well, but it is not used as the mode of attachment to the binding, and must be stowed in the bag or elsewhere when the bag is attached to the snowboard.

A major disadvantage of these two types of prior art lies in the fact that adhesive VELCRO® is used as the mode of attachment to the snowboard. This means that the bag is not inter-changeable between snowboards unless the snowboard is equipped with the adhesive VELCRO®. Adhesive VELCRO® may be "semi-permanent" and could lead some consumers to think twice about sticking it to their snowboards due to concerns about removing it in the future, especially if the board were sold to another individual.

SUMMARY OF THE INVENTION

The present invention provides a bag which may be removably attached to the strap bindings of a snowboard, without requiring any modification or semi-permanent modification of the snowboard or binding. The present invention provides a large bag (or small bag) which may be sufficient in size to store various equipment or a camera and other items.

According to an aspect of the present invention, a bag for attaching to a binding of a snowboard has a strap that provides a plurality of different angled slots or strap receiving portions or apertures for receiving the straps of the snowboard binding. The slots include a plurality of generally vertical or non-angled slots and one or more first angled slots angled in a first direction and one or more second angled slots angled in a second direction. In use, one of the generally vertical slots receives one of the straps of the snowboard binding, such as a toe strap of the binding, while one of the angled slots (either one of the first angled slots or second angled slots depending on which foot the snowboarder puts in the binding) receives the angled ankle strap of the snowboard binding. The angled slots are angled to accommodate the angle of the ankle strap relative to the generally vertical orientation of the toe strap. The different angles are provided (with the first angled slot or slots being at or towards one end of the strap or bag and the second angled slot or slots being at or towards the opposite end of the strap or bag) to allow for universal attachment of the bag to a snowboard regardless of which foot the snowboarder has as his or her front foot.

Thus, snowboarders may be provided with a storage bag that is mounted on the snowboard itself, and that can be quickly attached and detached from a variety of snowboards without making any modifications to the snowboard itself. The weight of the bag may be kept to a minimum and the bag may include a shoulder strap for the user to carry the bag with when the bag is not attached to the snowboard bindings. Any size bag that would be practical to carry on the deck of a snowboard may be used with the mode of attachment of the present invention. The adaptations made to the bag, and the strap, allow the bag to be attached to a snowboard, such as to the strap bindings of the snowboard, without requiring any modifications to the snowboard or bindings.

DESCRIPTION OF THE PREFERRED EMBODIMENTS

Figure 1:
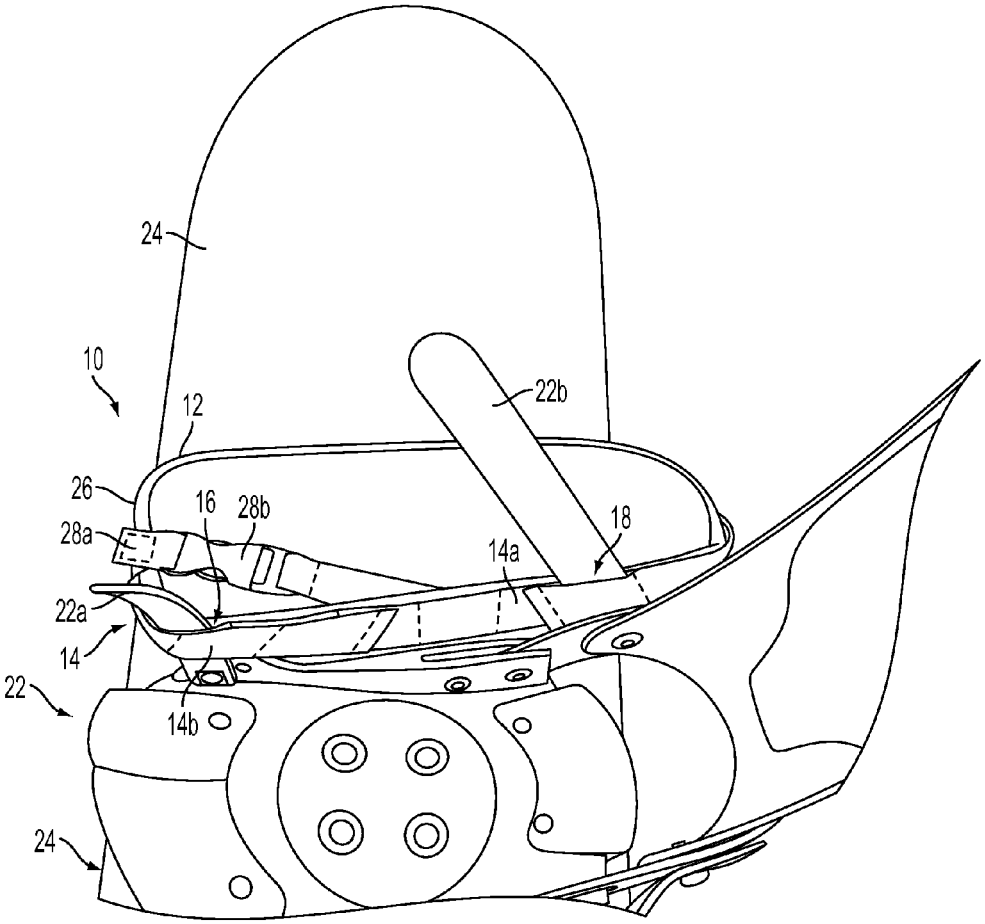
FIGS. 1 and 2 are perspective views of a carrying case in accordance with the present invention, as mounted to a binding of a snowboard.

Referring now to the drawings, a snowboard binding pack or carrying case or equipment storage bag 10 consists of two main components, namely, a bag 12 and a strap 14 (FIGS. 1-5). The strap 14 comprises a dual layer strap having an inner or bag facing strap portion 14*a* and an outer or outward facing strap portion 14*b*. The strap portions 14*a*, 14*b* are stitched or otherwise held together and to the bag 12 in a pattern that establishes a plurality of generally vertical slots 16 and a plurality of first angled slots 18 and a plurality of second angled slots 20, which are oriented to accommodate the angles of a toe strap 22*a* and ankle strap 22*b* of a snowboard binding 22 of a snowboard 24, as discussed below.

Figure 2:
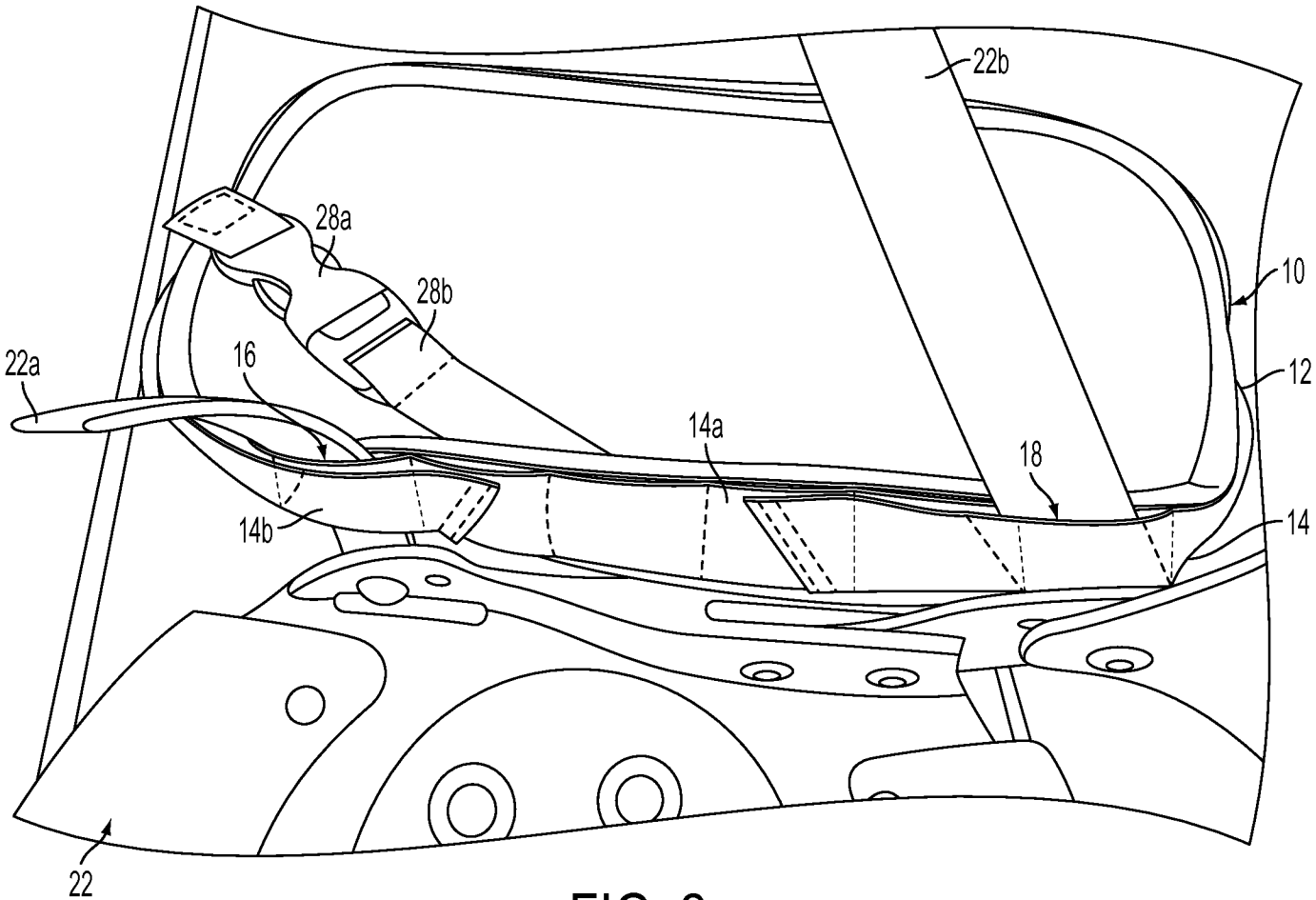

The snowboard binding market basically consists of bindings that are "strap-in" type bindings (and less common are "step-in" type bindings). The bag of the present invention is particularly suited for strap-in type bindings and is completely adaptable and interchangeable between snowboards using such conventional "strap-in" bindings, without requiring any modifications to the board or bindings. As shown in FIGS. 1 and 2, the bag and strap of the present invention is suitable for use on a strap-in type binding 22 by adjustably securing to the two straps (ankle and toe) that are used on "strap-in" bindings. The bag 12 may be positioned at a desired location relative to the snowboard binding and the strap may receive the toe strap 22*a* of the binding 22 through one of the vertical slots 16 and may receive the ankle strap 22*b* of the binding 22 through one of the first angled slots 18, as shown in FIGS. 1 and 2. The straps 22*a*, 22*b* may then be secured over and around the snowboarder's boot in a known manner, while the bag is retained at the snowboard via the strap 14.

Figure 3:
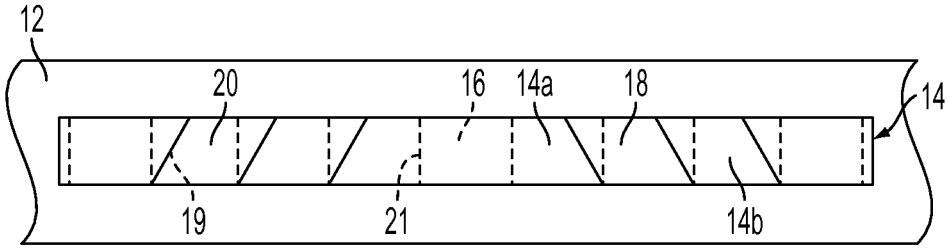
FIG. 3 is a plan view of a strap for the carrying case of the present invention.
Figure 4:
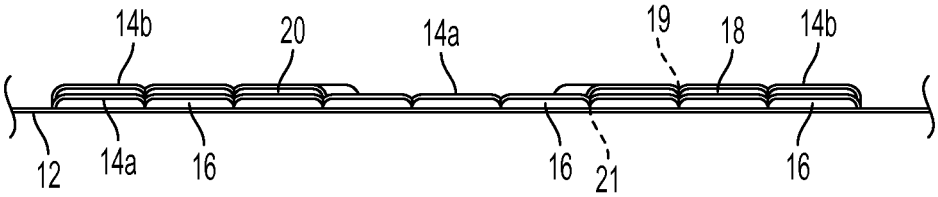
FIG. 4 is a side elevation of the strap of FIG. 3.
Figure 5:
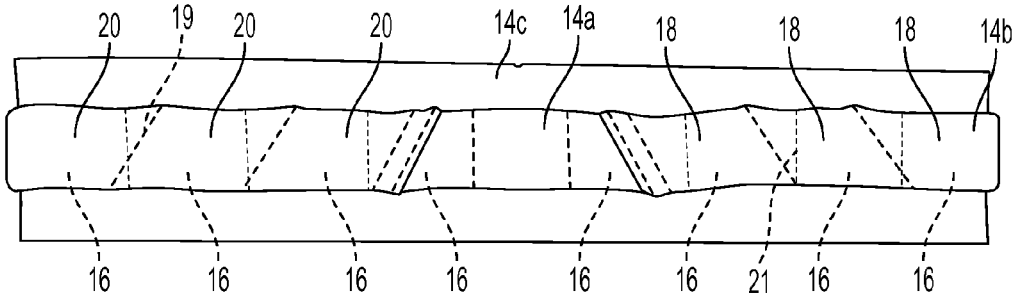
FIG. 5 is another plan view of a strap similar to the strap of FIGS. 3 and 4.

In the illustrated embodiment, and as shown in FIGS. 3-5, strap portions 14*a*, 14*b* of strap 14 of carrying case 10 are stitched or formed together to establish the plurality of angled slots 18, therebetween. The first angled slots 18 may be formed at or towards one end of the strap 14 (such as via angled stitch lines or stitches 19), while the second angled slots 20 may be formed at or towards the other end of the strap 14 (such as via generally vertically oriented stitch lines or stitches 21). The inner strap portion 14*b* is stitched or formed at the bag 12 in a manner that forms or establishes the generally vertical slots 16 between the bag 12 and the inner strap portion 14*b*. The generally vertical slots 16 may be formed at or towards both ends of the strap 14. Optionally, the inner strap portion 14*b* may be stitched or formed to a third strap portion or layer 14*c* (FIG. 5), and that strap 14 may be attached by attaching the third or inner or lower strap portion or layer 14*c* to the carrying case or bag, such as to an outer portion or layer of the carrying case or bag (such as via stitching or any suitable attaching means, such as hook and loop fasteners or snaps or buttons or the like).

Thus, the snowboarder may position the carrying case 10 at his or her strap binding 22 and insert the toe strap 22*a* through an appropriate one of the vertical slots 16 and the ankle strap 22*b* through an appropriate one of the first angled slots 18. Because the strap 14 and bag 12 provide multiple vertical slots and angled slots, the snowboarder may select an appropriate set of slots 16, 18 so that, when the carrying case 10 is attached at the snowboard 24, the bag 12 may rest on the snowboard 24 and not be at an awkward angle or otherwise not secured at the snowboard. If another snowboarder (that has his or her binding placement the reverse of the first snowboarder) uses a carrying case of the present invention, the second snowboarder would insert the toe strap through one of the vertical slots 16 at or towards the opposite end of the strap 14 and the ankle strap through one of the second angled slots 20, whereby the bag 12 again would rest on the snowboard in a stable manner.

For example, and with reference to FIGS. 1 and 2, the carrying case may be mounted at a right foot binding as shown, and the toe strap may be received through a generally vertical slot at a first end region of the strap, while the ankle strap may be received through an appropriate or selected angled slot at the opposite or second end region of the strap, whereby the toe and angle straps are wrapped over the snowboarder's boot and secured to the other side of the binding. For a different snowboarder (who, for example, wants to attach the carrying case to a left foot binding) and snowboard/binding, the toe strap of the opposite or left foot binding may be received through a generally vertical slot at the second end region of the strap, while the ankle strap may be received through an appropriate or selected angled slot at the opposite or first end region of the strap, whereby the toe and angle straps are wrapped over the snowboarder's boot and secured to the other side of the binding. Thus, the present invention provides a reversible carrying case that can readily be attached or mounted at a snowboard binding of a snowboard, whereby the bag is retained in place at the binding and rests on the upper surface of the snowboard in a stable manner. The present invention also provides, by including a plurality of side-by-side generally vertical slots and a plurality of side-by-side first and second angled slots at opposite end regions of the strap, a carrying case that is configured or is readily adaptable for almost all sizes of bindings, where a user may insert the straps through the more centrally located slots for smaller sized bindings and may insert the binding straps through the outer or end slots of the strap for larger sized bindings, without requiring any adjustment to the bag or strap or carrying case.

Optionally, and as can be seen in FIGS. 1 and 2, the bag 12 may include a zipper 26 to allow for opening and closing the bag 12 by the user of the bag. In the illustrated embodiment, the zipper 26 has a first clasping portion or snap portion 28*a* attached thereto, and the bag 12 has a second clasping portion or snap portion 28*b* attached thereto. Thus, when the bag is closed, the clasping portions 28*a*, 28*b* may be clasped or snapped together to secure the zipper in its closed position to limit or substantially preclude unintentional opening of the bag during use, such as while the snowboarder is snowboarding or the like.

Optionally, it is envisioned that the strap may comprise three layers or portions that form or establish (such as via stitching patterns) the angled slots and the vertical slots, whereby the strap may be provided as an aftermarket strap to attach to any bag or device for mounting the bag or device to a snowboard binding or the like (such as similar to the strap shown in FIG. 5). For example, the strap may be selectively attached to any suitable bag or device via hook and loop type fasteners (such as VELCRO® or the like) or via snaps or stitching or the like. The strap may be sewn to the bag or may be removably attached to the bag, while remaining within the spirit and scope of the present invention. Optionally, it is envisioned that the strap may be removably attachable to the bag (or the bag may include another strap or shoulder strap or harness) and may be removed to serve a dual purpose, such as by attaching the strap at opposite ends to the bag to provide a shoulder strap for the carrying case when the carrying case is not mounted to the binding of the snowboard.

Thus, the dual layer webbing binding pack mounting assembly of the present invention provides a unique sewn webbing loop assembly designed to match seamlessly with a typical strap-in snowboard binding and allow for a bag or other object to be securely mounted to the binding. The inner layer of webbing is sewn to the bag via a series of vertical stitches creating a plurality of generally vertical passageways or slots or loops (such as, for example, nine slots) along the length of the strap assembly. The outer layer of the dual layer webbing is sewed to the inner layer via stitching that is at an angle of at least about 15 degrees from the vertical stitching and preferably at least about 25 degrees from the vertical stitching, such as approximately 30 degrees from the vertical stitching or thereabouts (or more or less), and creates or establishes a plurality of angled passageways or slots or loops (such as, for example, three angled slots at one end of the strap and three oppositely angled slots at the other end of the strap) on top of the vertical loops below. The selected stitching angles closely match the angle of an ankle strap on a typical snowboard binding when in use. This allows the bag to have a better alignment on the binding and leads to a enhanced overall appearance and functionality, and avoids bending or bunching up of the bag and/or strap when the carrying case is mounted at the snowboard binding. The outer loops are angled inward towards the center region of the strap such that the bag may be mounted to either the left or right binding, and thus the carrying case of the present invention provides a universal mounting system for any strap-in binding of any snowboard. The carrying case of the present invention thus allows enhanced flexibility in mounting and improved positioning of the bag on the binding.

Although shown and described as having stitching on the strap and bag, clearly other means of securing the strap portions together and to the bag may be utilized, such as snaps, buttons, clasps, zippers, VELCRO® and/or the like, may be implemented without affecting the scope of the present invention. Although shown and described as being mountable to a strap binding of a snowboard, it is envisioned that the bag and strap of the present invention may be suitable for use in a variety of applications where it is desired to adjustably position or mount a case or bag or container to a mounting structure or the like.

Therefore, the present invention provides a small storage bag (such as, for example, approximately 500 cubic cm or thereabouts, or larger or smaller) is attachable directly to a conventional "strap-in" snowboard binding. The strap used to secure the bag to the snowboard binding allows for universal attachment to snowboard bindings and accommodates different sized bindings (where the toe and ankle straps may be inserted through slots that are closer together or farther apart) and accommodates left or right foot bindings (where the ankle strap is inserted through a selected one of the two different angled slots), thereby allowing the bag's position to be adjusted to fit a variety of binding types, as well as to accommodate a variety of positions of the bindings as they are mounted on different snowboards. The multiple slots allow adjustment of the position of the bag perpendicular to that of the length of the snowboard. They also allow the bag to be mounted on either binding, inside or "between the legs" as well as outside on the front or back of the snowboard. The present invention thus provides flexible positioning and adjustment of the bag while attached to the snowboard, as well as allowing the bag to be used on virtually any snowboard with conventional "strap-in" bindings.

Changes and modifications in the specifically described embodiments may be carried out without departing from the principles of the present invention, which is intended to be limited only by the scope of the appended claims, as interpreted according to the principles of patent law.

The embodiments of the invention in which an exclusive property or privilege is claimed are defined as follows:

1. A carrying case adjustably mountable to a binding of a snowboard, said carrying case comprising:

a bag;

a mounting strap configured for attachment at said bag;

wherein a plurality of generally vertical slots, at least one first angled slot and at least one second angled slot are established either through said mounting strap or between said mounting strap and said bag;

wherein said generally vertical slots are configured to receive a toe strap of a snowboard binding therethrough while said first and second angled slots are configured to receive an ankle strap of the snowboard binding therethrough; and wherein said at least one first angled slot comprises a plurality of first angled slots arranged side-by-side along a first end region of said mounting strap and wherein said at least one second angled slot comprises a plurality of second angled slots arranged side-by-side along a second end region of said mounting strap.

2. The carrying case of claim 1, wherein said first angled slots are established at a first end region of said mounting strap and are angled towards a generally central region of said mounting strap and wherein said second angled slots are established at a second end region of said mounting strap and are angled towards said generally central region of said mounting strap.

3. The carrying case of claim 1, wherein, when said carrying case is mounted to a left foot binding of a snowboard, the ankle strap of the left foot binding is received through said first angled slot at said first end region of said mounting strap and the toe strap of the left foot binding is received through one of said generally vertical slots at or near said second end region of said mounting strap, and wherein, when said carrying case is mounted to a right foot binding of a snowboard, the ankle strap of the right foot binding is received through said second angled slot at said second end region of said mounting strap and the toe strap of the right foot binding is received through one of said generally vertical slots at or near said first end region of said mounting strap.

4. The carrying case of claim 1, wherein one of said generally vertical slots and said first and second angled slots are established between an inner strap portion and an outer strap portion and another of said generally vertical slots and said first and second angled slots are established between said inner strap portion and said bag.

5. The carrying case of claim 1, wherein said first and second angled slots are angled at about 30 degrees from the orientation of said generally vertical slots.

6. The carrying case of claim 1, wherein said bag includes a locking mechanism to secure an opening device of said bag in a closed position.

7. A carrying case adjustably mountable to a binding of a snowboard, said carrying case comprising:

a bag;

a mounting strap configured for attachment at said bag;

wherein said mounting strap comprises first, second and third layers of fabric, and wherein a plurality of generally vertical slots are established between said first and second layers of fabric and at least one first angled slot and at least one second angled slot are established between said second and third layers of fabric;

wherein, when said mounting strap is attached at said bag and said carrying case is disposed at a snowboard, one of said generally vertical slots receives a toe strap of a snowboard binding therethrough while one of said first and second angled slots receive an ankle strap of the snowboard binding therethrough to mount said carrying case to the binding of the snowboard;

wherein said at least one first angled slot is established at a first end region of said mounting strap and is angled towards a generally central region of said mounting strap and wherein said at least one second angled slot is established at a second end region of said mounting strap and is angled towards said generally central region of said mounting strap; and wherein said at least one first angled slot comprises a plurality of first angled slots arranged side-by-side along said first end region of said mounting strap and wherein said at least one second angled slot comprises a plurality of second angled slots arranged side-by-side along said second end region of said mounting strap.

8. The carrying case of claim 7, wherein one of said first layer of fabric and said third layer of fabric comprises an outer layer of said bag.

9. The carrying case of claim 7, wherein one of said first layer of fabric and said third layer of fabric is configured for attachment to a portion of said bag.

10. The carrying case of claim 7, wherein, when said carrying case is mounted at a left foot binding of a snowboard, the ankle strap of the left foot binding is received through one of said first angled slots at said first end region of said mounting strap and the toe strap of the left foot binding is received through one of said generally vertical slots at or near said second end region of said mounting strap, and wherein, when said carrying case is mounted to a right foot binding of a snowboard, the ankle strap of the right foot binding is received through one of said second angled slots at said second end region of said mounting strap and the toe strap of the right foot binding is received through one of said generally vertical slots at or near said first end region of said mounting strap.

11. The carrying case of claim 10, wherein said first and second angled slots are angled at about 30 degrees from the orientation of said generally vertical slots and towards said generally central region of said mounting strap.

12. The carrying case of claim 7, wherein said plurality of first angled slots and said plurality of second angled slots and said plurality of generally vertical slots allow for selection of an appropriate pair of slots for receiving the ankle strap and toe strap of different sized snowboard bindings.

13. The carrying case of claim 7, wherein said bag includes a locking mechanism to secure an opening device of said bag in a closed position.

* * * * *

UNITED STATES PATENT AND TRADEMARK OFFICE

CERTIFICATE OF CORRECTION

PATENT NO. : 8,746,520 B1
APPLICATION NO. : 13/152707
DATED : June 10, 2014
INVENTOR(S) : Michael J. Buth It is certified that error appears in the above-identified patent and that said Letters Patent is hereby corrected as shown below:

In the Specification

Column 2
Line 66, Insert --20-- after "slots 18,"

Signed and Sealed this
Thirtieth Day of June, 2015

Michelle K. Lee

Michelle K. Lee
*Director of the United States Patent and Trademark Office*